US007931770B2

(12) United States Patent
Bortolato

(10) Patent No.: US 7,931,770 B2
(45) Date of Patent: Apr. 26, 2011

(54) PROCESS AND EQUIPMENT FOR CONTINUOUS DECORATION OF STRUCTURAL SHAPES BY SUBLIMATION

(75) Inventor: Giovanni Bortolato, Carate Brianza (IT)

(73) Assignee: Lasa Impianti, S.r.l., Carate Brianza MI (IT)

( * ) Notice: Subject to any disclaimer, the term of this patent is extended or adjusted under 35 U.S.C. 154(b) by 900 days.

(21) Appl. No.: 11/628,239

(22) PCT Filed: Sep. 26, 2005

(86) PCT No.: PCT/EP2005/010382

§ 371 (c)(1),
(2), (4) Date: Dec. 1, 2006

(87) PCT Pub. No.: WO2006/037506

PCT Pub. Date: Apr. 13, 2006

(65) Prior Publication Data

US 2007/0240812 A1 Oct. 18, 2007

(30) Foreign Application Priority Data

Oct. 6, 2004 (IT) ..... MI2004A1891

(51) Int. Cl.
*B44C 1/165* (2006.01)

(52) U.S. Cl. ..... 156/230; 156/441.5

(58) Field of Classification Search ..... 156/230, 156/441.5

See application file for complete search history.

(56) References Cited

U.S. PATENT DOCUMENTS

| | | | | |
|---|---|---|---|---|
| 5,962,368 | A * | 10/1999 | Poole | 503/227 |
| 2003/0192136 | A1 * | 10/2003 | Magee et al. | 8/500 |
| 2005/0011614 | A1 * | 1/2005 | Benetton | 156/583.1 |

FOREIGN PATENT DOCUMENTS

| | | |
|---|---|---|
| EP | 0888905 | 1/1999 |
| EP | 0 953 457 | * 11/1999 |
| EP | 0953457 | 11/1999 |
| EP | 1055524 | 11/2000 |
| GB | 2 345 661 | * 7/2000 |
| GB | 2345661 | 7/2000 |
| WO | WO02/43970 | 6/2002 |

* cited by examiner

*Primary Examiner* — Khanh Nguyen
*Assistant Examiner* — Vishal I Patel
(74) *Attorney, Agent, or Firm* — Jacobson Holman PLLC

(57) ABSTRACT

Continuous decoration process with a film of inked plastic material enclosing a structural shape and consisting of the following steps: perform continuous wrapping of the structural shape with inked film (4, 5), place under pressure the film wrapping the structural shape (7), keep the film under pressure, heat the structural shape wrapped in the film to the sublimation temperature and perform the sublimation (9, 10), automatically detach the exhausted film from the structural shape (11), cool the structural shape (12), and unload and accumulate the decorated structural shape devoid of film (13, 14).

8 Claims, 2 Drawing Sheets

PROCESS AND EQUIPMENT FOR CONTINUOUS DECORATION OF STRUCTURAL SHAPES BY SUBLIMATION

This is a nationalization of PCT/EP2005/010382 filed 26 Sep. 2006 and published in English.

This invention relates to a process and equipment for continuous decoration of structural shapes.

In the field of decoration of metallic structural shapes of any type and form by means of an ink sublimation process reproducing the drawing to be transferred there are many different types of systems allowing realization of the decoration by applying said process.

But said systems necessarily require control and handling of the structural shape by workers.

The systems used for decoration of metallic structural shape are generally made up of two machines. The first machine performs the automatic putting into envelopes while the second machine generally calls for one or more carts and a heating oven.

Once put in envelopes by the machine that performs the automatic enveloping operation, the structural shapes are arranged on said carts provided with sucking heads. The ends of the enveloped structural shape are then connected to said sucking heads that allow adhesion of the film to the structural shape by the creation of a depression.

But since the film has necessarily a development longer than the perimeter of the structural shape, between the structural shape and the film there are formed linear sags that if not eliminated cause visually appreciable defects in the decorated final product. Indeed, the films used in known machines having to withstand mechanical stresses, for example due to connection with the sucking heads, are films of considerable thickness (generally approximately 20 microns).

Hence the necessary involvement of workers who manually eliminate the wrinkles and reposition the film in the hollows of the structural shape, hollows in which the film did not succeed in entering due only to the depression effect.

Then the carts enter into the oven where the structural shapes enveloped and placed under depression to realize adhesion of the film to the structural shape are taken to the sublimation temperature.

Then with present techniques to achieve wrapping and perfect adhesion of a film or inked sheet to a structural shape, i.e. to a drawn aluminum support whose length is normally variable between six and seven meters, the manual involvement of a certain number of persons is necessary. Therefore the known techniques that require great use of labor are characterized by resulting low productivity.

In addition the structural shapes must be protected at the ends with adhesive tape to eliminate sharp edges that would cause breakage during creation of the depression and subsequent handling.

As indicated above, a technique used to make the film adhere to the structural shapes requires creation by means of known types of machines of a bag enclosing the structural shape.

Said bag is made from a sheet of inked film on which the structural shape already protected at the ends is deposited.

The longitudinal edges of said sheet are welded by means of heat or ultrasounds so as to enclose the structural shape in the film cylinder thus formed.

Once the film is cut at the ends leaving a length of approximately 200 mm excess for each side of the structural shape said ends are inserted in and connected to the suction means designed to generate the vacuum. By means of the depression generated by the suction means, the bag adheres to the structural shape surface to be decorated by sublimation.

A second technique uses the electrostatic charge to realize adhesion of the film to the structural shape surface.

Both of these processes as already mentioned have a considerable drawback; during creation of the depression the bag sags causing even the superimposition of parts of the drawing and forming irregular sags that require manual involvement to be smoothed and arranged according to the continuity of the surface.

As above-mentioned, this repositioning of the film is done by workers who intervene manually to smooth the sags if any that have been formed and to adapt the film to the structural shape surface by hand.

The general purpose of this invention is to remedy the above mentioned prior art shortcomings and in particular consists of identifying a process and a device allowing avoiding manual involvement of the workers for the entire processing cycle while eliminating the requirement to protect the ends of the structural shape with adhesive tape and reduce film consumption, labor, power consumption and over all costs of the process.

The subject of this invention is thus a continuous decoration process with an inked plastic film resistant to sublimation temperatures and enclosing in it a structural shape and consisting of the following steps:

a) automatically and continuously perform wrapping of the structural shapes with film,
b) put the film under pressure with forced air to cause the film to enter the longitudinal hollows in the structural shapes,
c) heat the film-wrapped structural shape and kept under pressure for the entire duration of heating to the sublimation temperature,
d) remove the exhausted film automatically, and
e) cool the structural shapes and automatically unload the decorated structural shape devoid of film.

Another subject of this invention is equipment for the realization of a continuous decoration process with an inked plastic film resistant to sublimation temperatures and enclosing in it a structural shape by sublimation of inks reproducing the drawing to be transferred and consisting of: an automatic conveyor; a molder complete with sealed-closing device for the tubular sheath that covers the structural shape; a device with air under pressure for making contact between the film and the structural shape; a hot air oven under pressure; a device for detaching and accumulation of the exhausted sheath; a cooling device; and an unloader and automatic accumulation of the decorated structural shape.

The system described is the linear type but other configurations can be executed.

Figure 1:
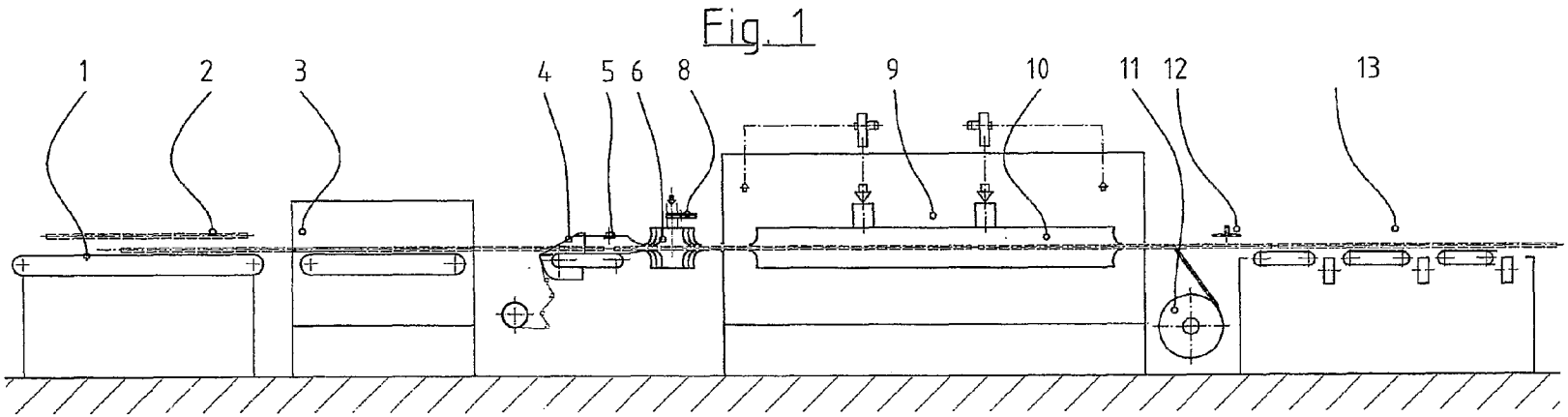
FIG. 1 illustrates an elevational view of a first embodiment of equipment suitable to perform the process for continuous decoration of objects according to the present invention.
Figure 2:
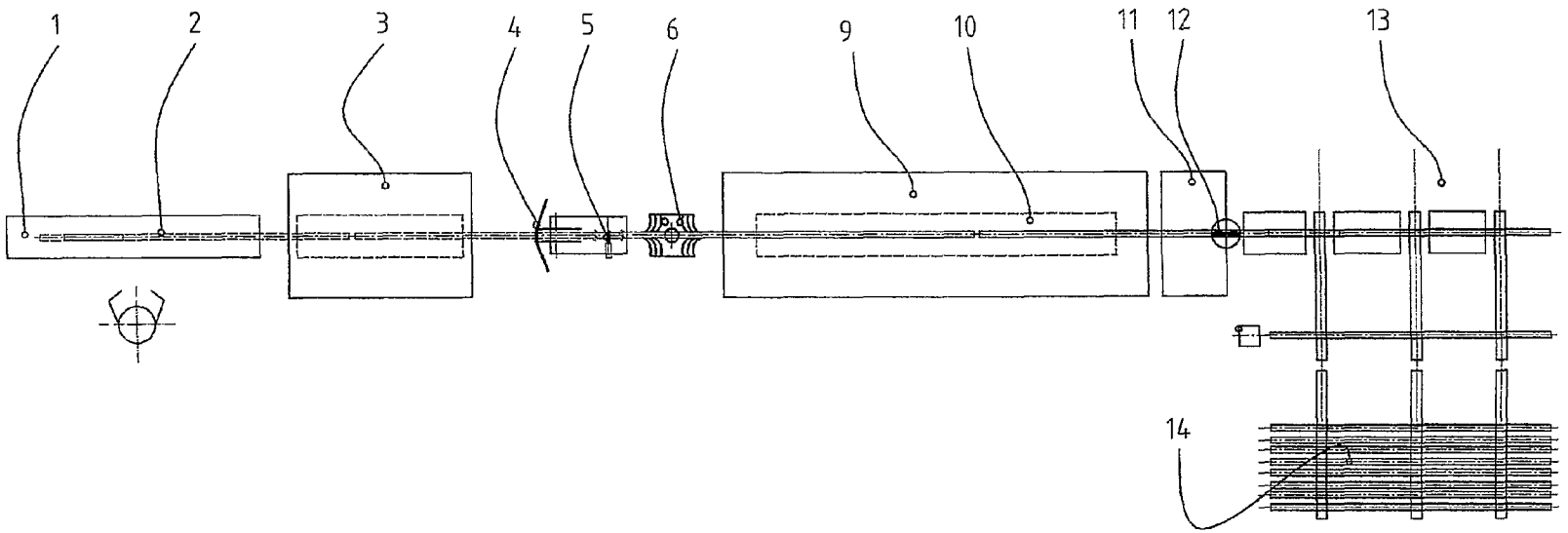
FIG. 2 illustrates a top plan view of the equipment of FIG. 1.
Figure 3:
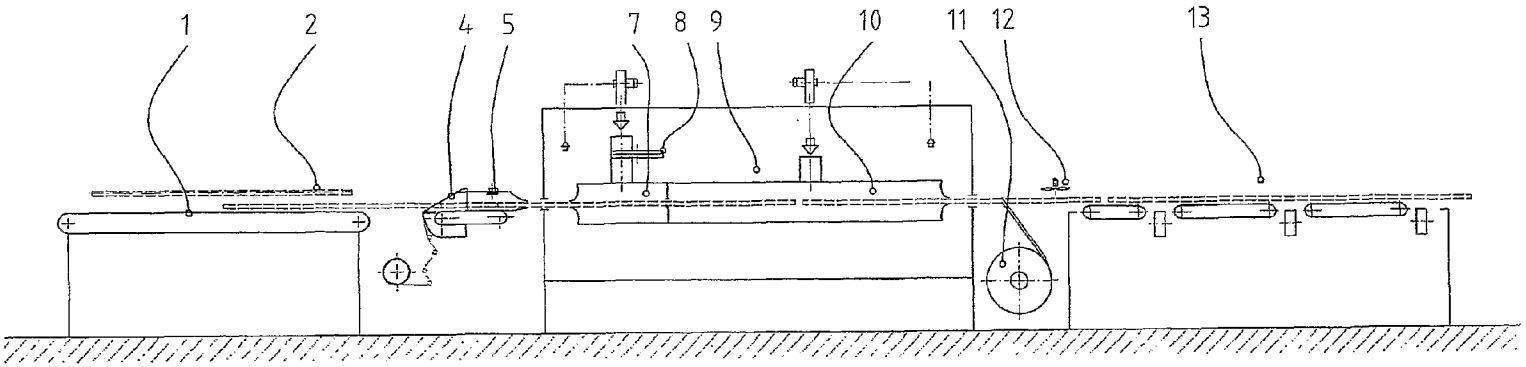
FIG. 3 illustrates an elevational view of a second embodiment of equipment suitable to perform the process for continuous decoration of objects according to the present invention.
Figure 4:
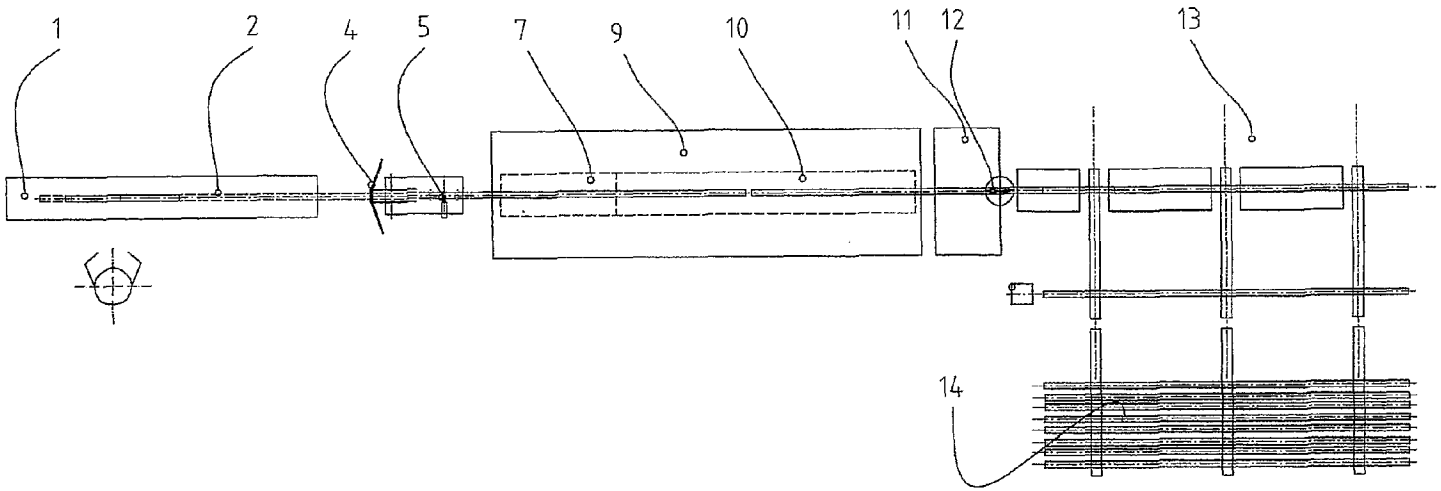
FIG. 4 illustrates a top plan view of the equipment of FIG. 3.

Among the linear configurations, two solutions are possible and illustrated in the two drawings (FIG. 1 elevation view and FIG. 2 plan view) and (FIG. 3 elevation view and FIG. 4 plan view).

Configuration 1 (FIG. 1 and FIG. 2) comprises the following.

Position 1 represents the loading belt. Position 2 represents the structural shapes to be decorated. Position 3 represents a linear heating oven designed to preheat the structural shape to a temperature of approximately 140° C. during its advancement. The structural shape then enters the molder (position 4) where sealed wrapping and welding (position 5) take place.

The structural shape thus wrapped enters into a pressurized chamber (position 6) where due to the external pressure the film is pressed into contact with the structural shape surface while entering even into the longitudinal fissures on the structural shapes to further improve said function while the air can be sent into the pressurized chamber in a pulsed manner by a device (position 8). This function improves entry of the film into the hollows.

By means of the pressurized chamber (position 10) the sublimation oven (position 9) with special construction keeps the film wrapping the structural shape under pressure for its entire length until it reaches the sublimation temperature of approximately 190° C. to 200° C.

The oven has low energy consumption as it has small inlets and outlets and the energy is used almost entirely to take the structural shape to temperature.

A device (position 11) for detaching and accumulation of the exhausted film, a cooling device (position 12), an unloading device (position 13) and an accumulation device (position 14).

Configuration 2 comprises (FIGS. 3 and 4) the following.

Position 1 represents the loading belt. Position 2 represents the profiles to be decorated. The structural shape then enters into the molder (position 4) where sealed wrapping and welding (position 5) take place.

The structural shape thus wrapped enters into a pressurized chamber of the oven (position 7) where due to the external pressure the film is thrust into contact with the surface of the structural shape while entering even into the longitudinal fissures on the structural shapes and to further improve said function the air can be sent into the pressure chamber by a device (position 8) in pulsed manner and this function improves entry of the film into the hollows.

The sublimation oven (position 9) with special construction allows keeping pressure on the film that wraps the structural shape by means of the pressurized chamber (position 10) for its entire length until reaching the sublimation temperature (190° C. to 200° C. for a time period varying between 60 and 180 seconds).

The oven has low energy consumption as it has small inlets and outlets and the energy is used almost entirely to take the structural shape to temperature.

A device (position 11) for detaching and accumulation of the exhausted film, a cooling device (position 12), an unloading device (position 13) and an accumulation device (position 14).

The main advantage of the process and equipment in accordance with this invention is realizing an entirely automatic finishing operation with no possibility of errors due to the use of workers and their skill.

Another advantage of the process and equipment is the fact that in the hollows where possibly there is not contact between the film and the paint of the structural shape the spreading of the inks (not evacuated by the vacuum) allows a longer contact time and better decoration so that the drawing shows no visible defects after sublimation even where there are sags since spreading of the inks can compensate for the small space where close contact between the part and the film does not take place.

The function and purpose of this invention is to avoid manual operations linked to the worker's ability, reduce the drawbacks of the techniques described and known at present, eliminate the need for protecting the ends of the structural shape with adhesive tape, reduce film consumption since the structural shapes are loaded one after the other with an average saving of 0.2 $m^2$ of film for each structural shape, and reduce labor and overall costs of the process.

With known machines, approximately 6 people are needed for production of 60 structural shapes 7 meters long per hour. With the new automatic machine, 120 to 180 structural shapes per hour can be produced using 2 people.

Therefore the advantages of the process and the equipment in accordance with this invention can be summarized in reduced costs due to the lower cost of the film, reduced labor cost, better decoration of angles, narrow radius edges and any sags, a better penetration of the inks over the entire thickness of the paint (polyester, acrylic, polyurethane or various mixtures).

Another advantage of this invention is the low power consumption of the oven since, having to pass one structural shape at a time, the outside dimensions of the oven and the inlets and outlets are small in size and they reduce losses to the minimum. Practically the near totality of the heat generated by the generator is used for heating the structural shape.

The invention claimed is:

1. A process for continuous decoration of objects by ink sublimation, with a film of inked plastic material virtually impermeable to air and resistant to ink sublimation temperature, the process comprising the steps of:

feeding a continuous sequence of objects along a feeding path by an automatic conveyor, performing sealed wrapping of the objects with a tubular sheath of inked film around a continuous sequence of wrapped objects arranged one after the other in the tubular sheath of inked film, making the tubular sheath of inked film adhere to the objects by applying external air pressure on the film-wrapped objects arranged one after the other in the tubular sheath of inked film while advancing along the feeding path, heating the film-wrapped objects to the ink sublimation temperature in an oven with external pressurized air while advancing along the feeding path until the objects are decorated by ink sublimation, automatically removing exhausted film from the decorated objects, cooling the decorated objects, and automatically unloading and accumulating the finished objects.

2. The process according to claim 1, wherein the external air under pressure for adhesion of the inked film to the objects is sent by a pulsing system.

3. The process according to claim 1, wherein a pre-heating step is performed before the sealed-wrapping step to pre-heat the objects to a temperature lower than the ink sublimation temperature, variable between 100° C. and 140° C., for a time varying between 30 seconds and 120 seconds.

4. The process according to claim 1, wherein application of external air pressure for adhesion of the inked film to the film-wrapped objects is performed before the objects enter the oven.

5. The process according to claim 1, wherein application of external air pressure for adhesion of the inked film to the film-wrapped objects is performed in a first part of the oven.

6. The process according to claim 1, wherein the external pressurized air presses the inked film against objects surfaces along the entire oven.

7. The process according to claim 1, wherein, in the sealed-wrapping step, the inked film wrapping the objects is closed by ultrasound welding or similar system, so as to have a tubular sheath with hermetic seal.

8. The process according to claim 1, wherein the decoration inked film is maintained continuous from wrapping of the objects in the sealed-wrapping step to removal of the exhausted film in the film-removal step.

* * * * *